US009757732B2

(12) United States Patent
Ahn et al.

(10) Patent No.: US 9,757,732 B2
(45) Date of Patent: Sep. 12, 2017

(54) PAPER SHREDDER

(71) Applicants: ROYAL SOVEREIGN QINGDAO INC., Qingdao, Shandong (CN); Hyun Joo Ahn, Seoul (KR)

(72) Inventors: Hyun Joo Ahn, Seoul (KR); Dae Seung Woo, Seoul (KR)

(73) Assignee: ROYAL SOVEREIGN QINGDAO INC., Qingdao, Shandong (CN)

( * ) Notice: Subject to any disclaimer, the term of this patent is extended or adjusted under 35 U.S.C. 154(b) by 248 days.

(21) Appl. No.: 14/434,090

(22) PCT Filed: Oct. 18, 2012

(86) PCT No.: PCT/KR2012/008533

§ 371 (c)(1),
(2) Date: Apr. 7, 2015

(87) PCT Pub. No.: WO2014/061836

PCT Pub. Date: Apr. 24, 2014

(65) Prior Publication Data

US 2015/0258549 A1 Sep. 17, 2015

(51) Int. Cl.
*B02C 23/02* (2006.01)
*B02C 18/00* (2006.01)

(52) U.S. Cl.
CPC ..... *B02C 18/0007* (2013.01); *B02C 23/02* (2013.01); *B02C 2018/0046* (2013.01)

(58) Field of Classification Search
CPC ..... B02C 18/0007; B02C 23/02; B02C 2018/0046
See application file for complete search history.

(56) References Cited

U.S. PATENT DOCUMENTS 8,403,246 B2 * 3/2013 Seo ..... B02C 18/0007 241/225
2005/0274836 A1 12/2005 Chen
2011/0253824 A1 * 10/2011 Aries ..... B02C 18/0007 241/222

FOREIGN PATENT DOCUMENTS

| | | | |
|---|---|---|---|
| JP | 3175898 | U | 5/2012 |
| KR | 100340696 | B1 | 6/2002 |
| KR | 20100096984 | A | 9/2010 |
| KR | 20120010931 | A | 2/2012 |

* cited by examiner

*Primary Examiner* — Mark Rosenbaum
(74) *Attorney, Agent, or Firm* — Loza & Loza, LLP; Heidi L. Eisenhut

(57) ABSTRACT

A paper shredder, according to one embodiment, includes a paper support unit including a first paper support unit having a first length, a second paper support unit which is parallel with the first paper support unit and has a second length shorter than the first length, and a paper input slot between the first paper support unit and the second paper support unit; a roller having a portion that is exposed to the upper side of the second paper support unit through an opening formed in the second paper support unit; a cutter which is disposed under the paper input slot and shreds inserted paper; and a cover disposed on the paper support unit.

13 Claims, 8 Drawing Sheets

PAPER SHREDDER

TECHNICAL FIELD

The present disclosure relates to a paper shredder.

RELATED ART

A paper shredder is an apparatus for quickly and safely shredding and eliminating unnecessary documents or confidential documents.

A paper shredder may shred paper which is manually input, or a large quantity of paper which is automatically input by using an automatic paper supply system. Particularly, when a large quantity of paper is automatically fed by using an automatic paper supply system for shredding, a failure such as a paper jam, an excessive paper feed, and a paper feeding failure may occur because the input paper is crumpled or torn.

In general, since paper input to a paper shredder is subjected to much damage over long-term use unlike paper input to an apparatus such as a copying machine, instances in which an automatic paper supply system does not operate normally are frequent.

DETAILED DESCRIPTION OF THE INVENTION

Technical Problem

Embodiments provide a paper shredder having a novel structure.

Embodiments also provide a paper shredder capable of reducing failures which occur in an automatic paper supply system, such as paper jams, excessive paper feeds, and paper feed failures.

Embodiments also provide a paper shredder capable of shredding papers more quickly.

Solution for Solving the Problem

In one embodiment, a paper shredder includes: a paper support unit including a first paper support unit having a first length, a second paper support unit which is parallel with the first paper support unit and has a second length shorter than the first length, and a paper input slot between the first paper support unit and the second paper support unit; a roller having a portion that is exposed to an upper side of the second paper support unit through an opening formed in the second paper support unit; a cutter which is disposed under the paper input slot and shreds inserted paper; and a cover disposed on the paper support unit.

Effects of the Invention

Embodiments of the present disclosure provide a paper shredder capable of reducing failures which occur in an automatic paper supply system, such as paper jams, excessive paper feeds, and paper feed failures.

Embodiments also provide a paper shredder capable of shredding paper more quickly.

MODE FOR CARRYING OUT THE INVENTION

Hereinafter, a paper shredder according to embodiments will be described in more detail with reference to the accompanying drawings.

Figure 1:
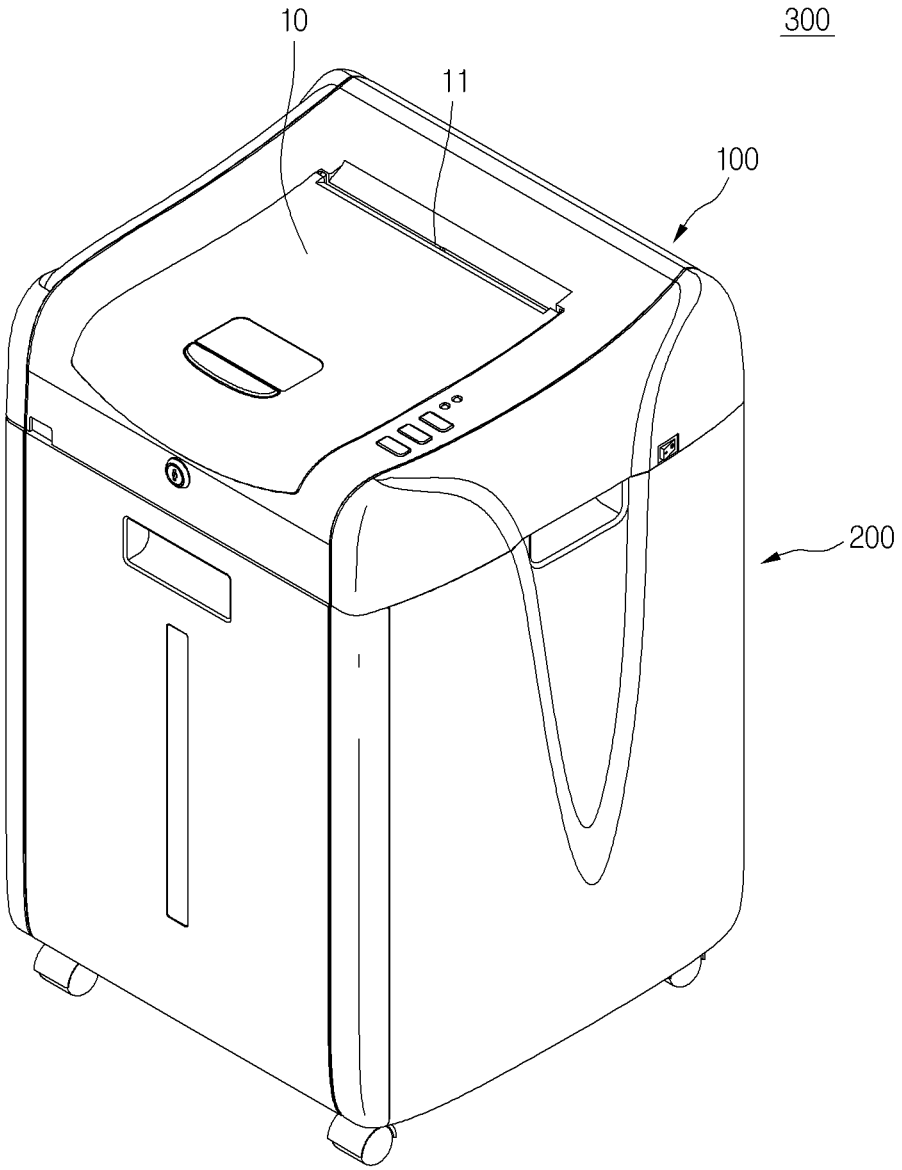
FIG. 1 is a perspective view of a paper shredder according to an embodiment.
Figure 2:
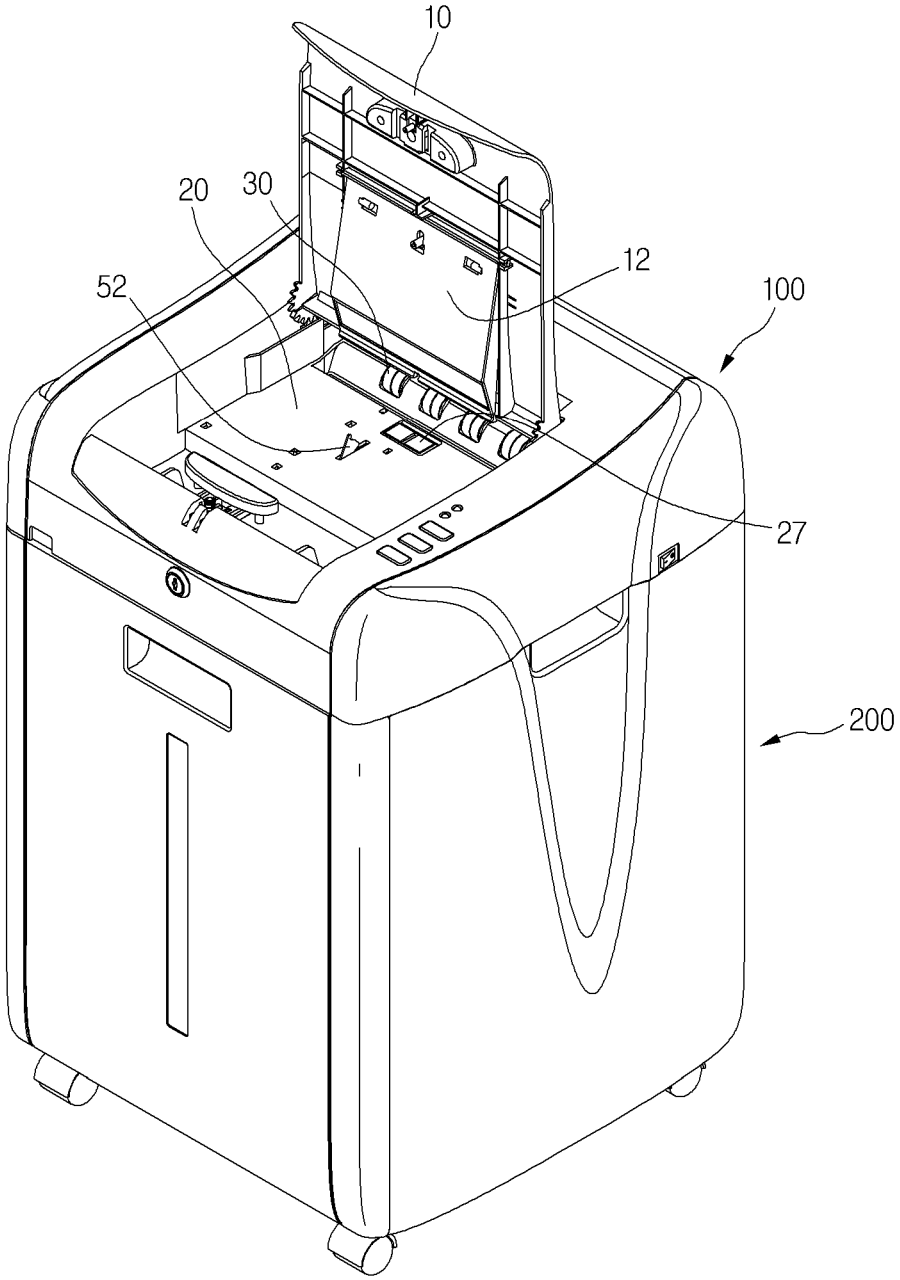
FIG. 2 is a perspective view illustrating a shape of a paper shredder with an opened cover according to an embodiment.
Figure 3:
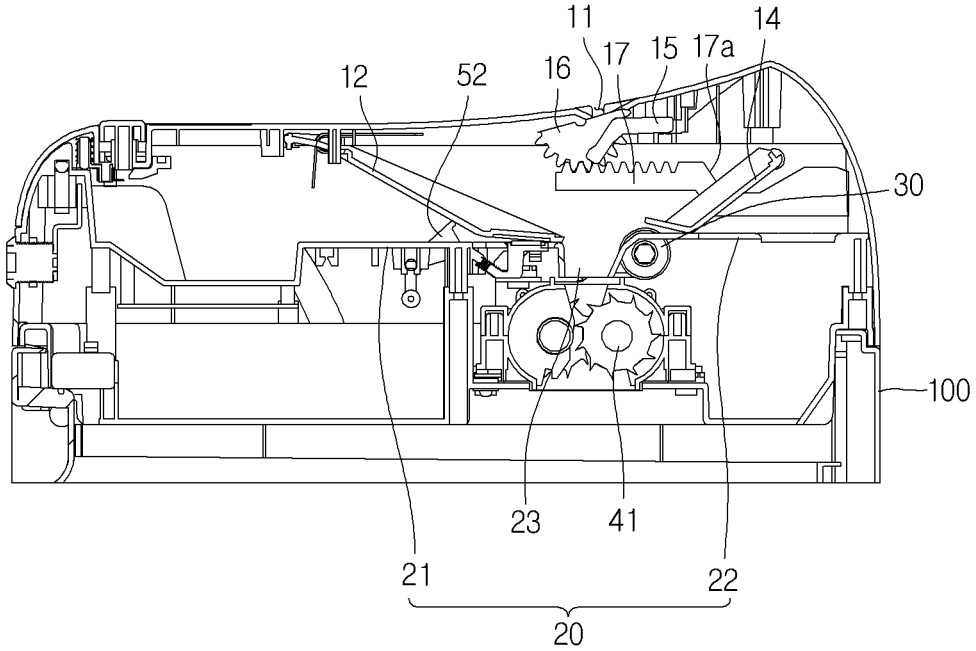
FIG. 3 is a cross-sectional view of a paper shredding part of a paper shredder according to an embodiment.
Figure 4:
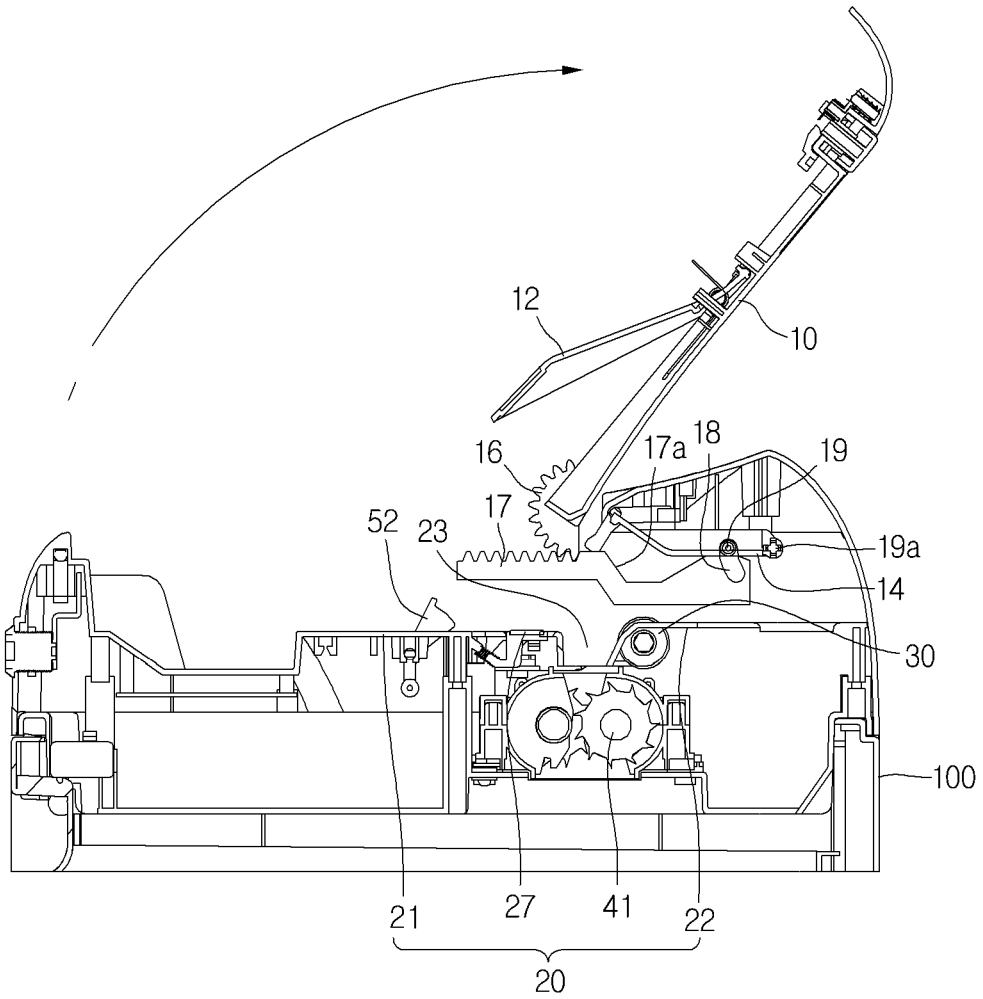
FIG. 4 is a cross-sectional view illustrating a shape of a paper shredder with an opened cover according to an embodiment.
Figure 5:
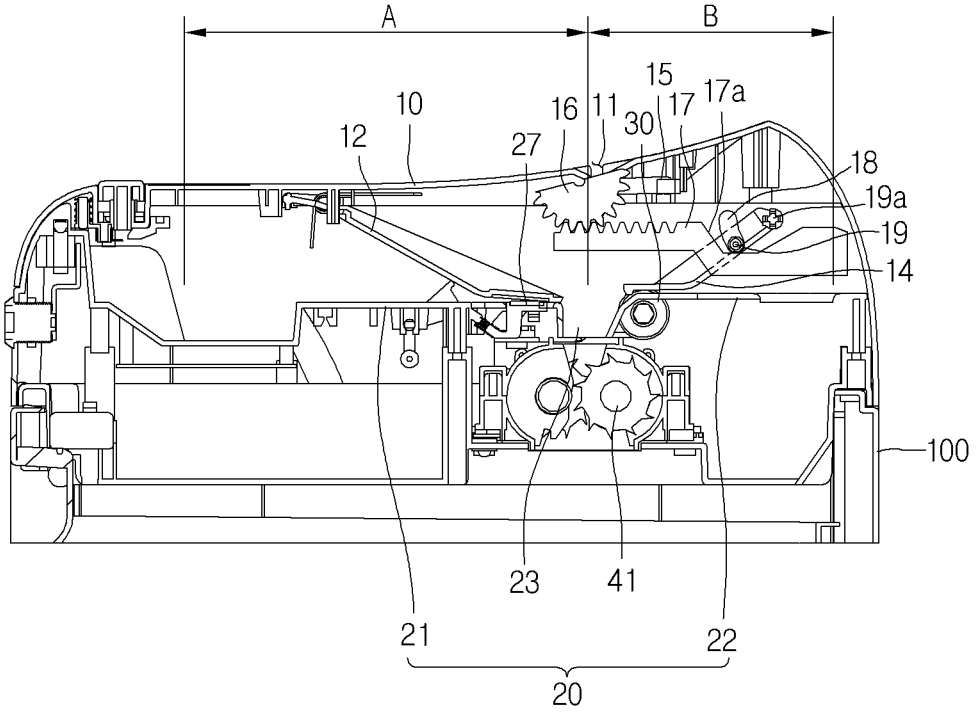
FIG. 5 is a cross-sectional view illustrating a shape of a paper shredder with a closed cover according to an embodiment.
Figure 6:
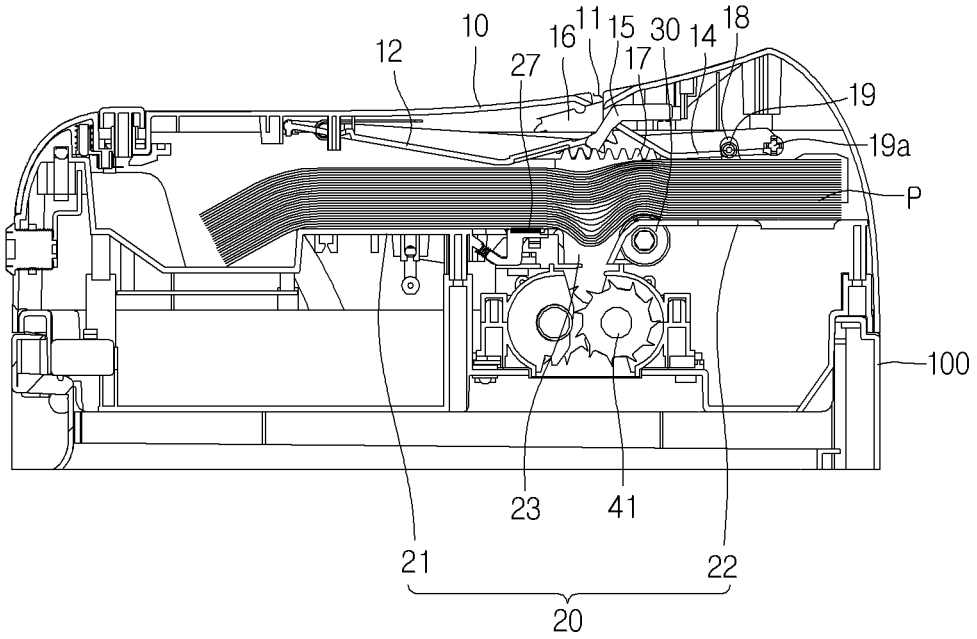
FIGS. 6 and 7 are views illustrating a paper shredding process in a paper shredder according to an embodiment.
Figure 7:
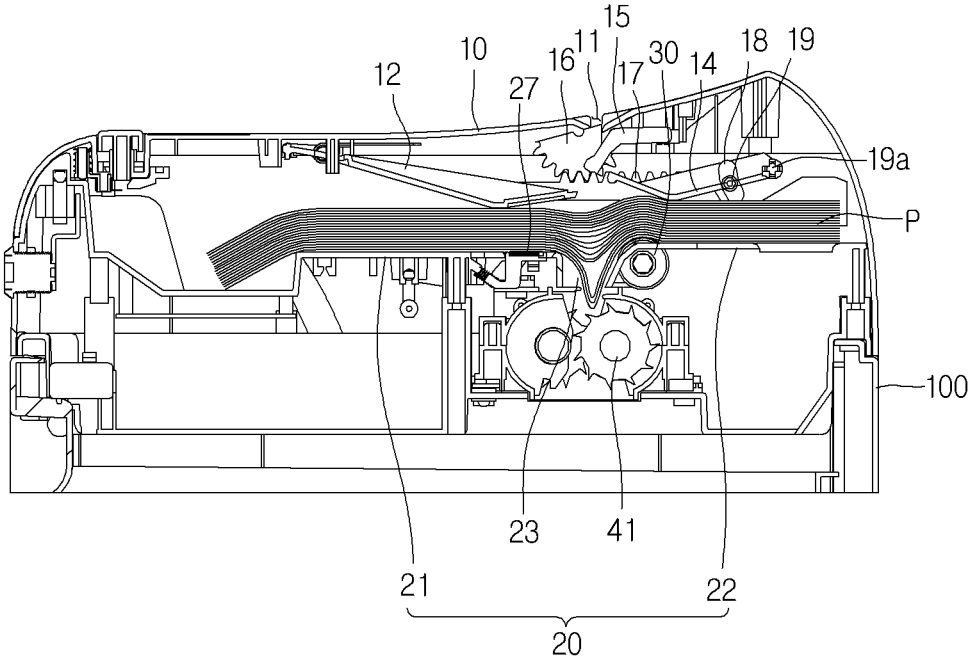

FIG. 1 is a perspective view of a paper shredder according to an embodiment; FIG. 2 is a perspective view illustrating a paper shredder with an opened cover according to an embodiment; FIG. 3 is a cross-sectional view of a paper shredding part of a paper shredder according to an embodiment; FIG. 4 is a cross-sectional view illustrating a shape of a paper shredder with an opened cover according to an embodiment; FIG. 5 is a cross-sectional view illustrating a shape of a paper shredder with a closed cover according to an embodiment; and FIGS. 6 and 7 are views illustrating a paper shredding process in a paper shredder according to an embodiment.

Referring to FIGS. 1 to 7, a paper shredder 300 according to embodiments includes a paper shredding part 100, and a paper box 200 disposed under the paper shredding part 100 to support the paper shredding part 100. The paper shredding part 100 is a part which shreds paper as the paper is input, and the paper box 200 is a part in which the shredded paper shredded by the paper shredding part 100 is stored.

In FIGS. 1 and 2, although the paper shredding part 100 and the paper box 200 are illustrated as being installed while being coupled to each other, the paper box 200 is not necessarily installed. That is, the paper shredder 300 according to embodiments may operate only with the paper shredding part 100, and the paper box 200 functions to store the shredded papers shredded at the paper shredding part 100 and to support the paper shredding part 100. For example, after fixing the paper shredding part 100 to an arbitrary apparatus, it is possible to install and use a disposable waste bag under the paper shredding part 100.

Also, it is possible to implement a design such that a motor, a control unit, an interface, etc., are included in the paper box 200 so that the paper shredding part 100 and the paper box 200 only operate when they are provided together.

The paper shredding part 100 includes a cover 10 and a paper support unit 20. The cover 10 is spaced a predetermined distance from the paper support unit 20, and the paper to be shredded is disposed in the space between the cover 10 and the paper support unit 20.

Referring to FIGS. 1 to 7, the paper support unit 20 includes a first paper support unit 21 and a second paper support unit 22. The first paper support unit 21 and the second paper support unit 22 are disposed at both sides of a paper input slot 23.

A roller 30 may be disposed in the paper support unit 20. That is, the roller may not be disposed in the first paper support unit 21, and at least one roller is disposed in the second paper support unit 22. In the current embodiment, it is illustrated that the roller is not disposed in the first paper support unit 21, and the roller 30 is disposed in the second paper support unit 22.

The sum of a first effective distance A of the first paper support unit 21 and a second effective distance B of the second paper support unit 22 may be substantially the same as or larger than a standard paper length, such as an A4 size or a letter size.

The first paper support unit 21 and the second paper support unit 22 are portions which are disposed under paper to support the paper when the paper is placed thereon. According to the surface shapes of the first and second paper support units 21 and 22, the surface area contacting paper may vary.

The first and second paper support units 21 and 22 are formed to have heights different from each other. That is, the first and second paper support units 21 and 22 are asymmetrically formed with respect to the paper input slot 23.

The second paper support unit 22 may be formed to be higher than the first paper support unit 21. For example, the surface of the second paper support unit 22 is formed to be higher than the first paper support unit 21 by about 3 mm to about 10 mm. That is, the first and second paper support units 21 and 22 have horizontal plates, and the horizontal plates of the first and second paper support units 21 and 22 are parallel to each other and have a height difference. In other words, the surfaces of the first and second paper support units 21 and 22 may have a gap of about 3 mm to about 10 mm between them.

As the height of the second paper support unit 22 is formed to be higher than the first paper support unit 21, paper, disposed at a portion of the paper input slot 23 positioned between the second paper support unit 22 and the first paper support unit 21, is given a curvature, and the paper may be naturally fed into the paper input slot 23 by the roller 30 disposed in the second paper support unit 22.

The roller 30 has a rotating axis disposed under the second paper support unit 22, and a portion thereof is exposed to an upper side of the second paper support unit 22 through an opening formed at the second paper support unit 22. The roller rotates in a first direction so that paper is moved in a direction toward the paper input slot 23. For example, in structures exemplarily illustrated in FIGS. 3 to 5, the first direction may be a counterclockwise direction, and the roller 30 may transfer the paper to the paper input slot 23 while rotating counterclockwise.

As the roller 30 rotates, the paper disposed on the first and second paper support units 21 and 22 is fed into the paper input slot 23 while a portion thereof which is disposed on the paper input slot 23 is folded.

The roller 30 has a surface contacting paper, which may be formed of a rubber material, or may also have sharp fins formed thereon such that the friction on the surface contacting the paper is increased.

Also, a slip prevention part 27 may be formed on the first paper support unit 21. For example, the slip prevention part 27 may be formed of a rubber material, and may also be disposed in plurality. When the roller 30 disposed in the second paper support unit 22 rotates counterclockwise, paper is not fed into the paper input slot 23, but may be moved while slipping in a direction toward the left of the paper input slot 23 (or toward the first paper support unit 21). The slip prevention part 27 prevents the paper from slipping, so that the paper is smoothly fed into the paper input slot 23.

A cutter 41 is disposed under the paper input slot 23. The cutter 41 functions to shred the papers fed through the paper input slot 23.

Also, a paper feed detection sensor may be disposed between the paper input slot 23 and the cutter 41. The paper feed detection sensor detects whether paper is fed through the paper input slot 23, so that the cutter may be prevented from rotating when paper is not fed into the paper input slot 23. For example, the paper feed detection sensor may be a photo sensor including a light emitting part and a light receiving part disposed at both sides of the paper input slot 23.

A motor (not shown) is disposed under the paper support unit 20. The motor drives the cutter 41 and the roller 30 when power is applied thereto. The motor, the cutter 41, and the roller 30 may be respectively connected by a gear, a belt, etc., to transfer torque generated by the motor, and the method for transferring the torque may be variously designed.

A paper stack detection sensor 52 may be disposed in the first paper support unit 21. The paper stack detection sensor 52 detects whether there is paper stacked on the first paper support unit 21, so that when there is no paper stacked on the first paper support unit 21, the cutter 41 and/or the roller 30 may be prevented from rotating after a predetermined time elapses.

The paper stack detection sensor 52 may be provided in various forms. For example, a photo sensor or a rotating lever may be used. In the current embodiment, the stack detection sensor 52 is illustrated using a rotating lever. When paper is stacked on the first paper support unit 21, a lever of the paper stack detection sensor 52 is rotated. When the rotation of the lever is detected by a photo sensor or the like, whether the papers are stacked may be detected.

The signals detected by the paper feed detection sensor and the paper stack detection sensor 52 are transmitted to a control unit (not shown). The control unit controls the operations of the cutter 41 and/or the roller 30 according to the signals transmitted from the paper feed detection sensor and the paper stack detection sensor 52.

The cover 10 is disposed at an upper side of the paper support unit 20 and is provided to be capable of being opened and closed as illustrated in FIGS. 1 and 2. The cover 10 may be disposed only at an upper side of the first paper support unit 21. That is, when the cover 10 is opened or closed, the center of rotation thereof may be positioned over the first paper support unit 21 or over the paper input slot 23.

The cover 10 includes a first press unit 12 and a second press unit 14. The first press unit 12 is disposed over the first paper support unit 21 and elastically supported by a spring. Also, the second press unit 14 is disposed over the second paper support unit 22 and elastically supported by a spring.

The first and second press units 12 and 14 press the paper disposed on the paper support unit 20, so that the paper is allowed to be smoothly fed into the paper input slot 23 by appropriate friction force as the roller 30 rotates.

Also, a manual paper input slot 11 may be further provided in the cover 10. The manual paper input slot 11 is disposed over the paper input slot 23 and is formed such that a small quantity of paper may be directly fed by a user.

In the current embodiment, the first paper support unit 21 is formed at a first effective distance A from the paper input slot 23, and the second paper support unit 22 is formed at a second effective distance B less than the first effective distance A from the paper input slot 23. That is, the first and second paper support units 21 and 22 are formed with asymmetrical lengths with respect to the paper input slot 23.

Typically, in printers, facsimiles, etc., when paper is transferred to the next process after being fed, the paper should be fed without a wrinkle from one end to the other end thereof so as to be suitable for the purpose of printing or copying. For a paper shredder, however, even if paper is crumpled or folded, this does not present a problem because the purpose of the paper shredder is to shred the paper. Particularly, since most paper for shredding is already in a damaged state in which the paper is bent due to long-term exposure to moisture, or are crumpled or torn, it is not easy to control the position of an end of a piece of paper such that the paper is fed into the paper input slot 23 from the end thereof for shredding.

Accordingly, in the paper shredder 300 according to the current embodiment, the shape of the paper support unit 20 is configured to be asymmetrical such that paper is fed into the paper input slot 23 while being asymmetrically folded.

FIGS. 6 and 7 are views illustrating a paper shredder in operation according to an embodiment.

Referring to FIGS. 4 to 7, in the paper shredder according to embodiments, the cover 10 is rotated to be opened such that the first paper support unit 21 is exposed as illustrated in FIG. 4.

A rotating gear 16 is coupled to the cover 10, and the rotating gear 16 rotates as the cover 10 is opened and closed. A horizontally moving gear 17 engages with the rotating gear 16. The horizontally moving gear 17 horizontally moves as the rotating gear 16 rotates. The horizontally moving gear 17 has an inclined surface, and a groove-shaped inclined surface 17*a* is exemplarily illustrated in the drawings.

A position adjusting member 19 is formed in the second press unit 14. The position adjusting member 19 moves along the inclined surface 17*a* of the horizontally moving gear 17 as the horizontally moving gear 17 moves. Accordingly, the second press unit 14 is moved. A guide groove 18 is formed in the paper shredder 100 to guide the position adjusting member 19 to naturally move upward and downward. Here, the second press unit 14 rotates about a hinged axis 19*a*. Since the second press unit 14 has elasticity applied thereto from a spring, when the cover 10 is closed, the second press unit 14 is in a state contacting the second paper support unit 22 as illustrated in FIG. 5. When the cover 10 is opened, the second press unit 14 is spaced apart from the second paper support unit 22 through the aforementioned operation.

Accordingly, it becomes easy to insert paper up to an upper side of the second paper support unit 22 while the cover 10 is opened. A large quantity of paper P is disposed on the paper support unit 20.

When the cover 10 is closed, the paper shredder 300 may start operating by detecting a signal from the paper stack detection sensor 52.

When the roller 30 rotates, from among the large quantity of paper P, paper of a first group adjacent to the roller 30—that is, paper disposed at a lower portion—is fed into the paper input slot 23 by receiving torque from the roller 30. The paper of the first group may be one sheet of paper or about 2 sheets to about 4 sheets of paper disposed at the bottom from among the large amount of paper P. That is, the number of sheets of paper which simultaneously move may be different according to the characteristics of the roller 30 or the state of the paper.

As the roller rotates, the paper P on the second paper support unit 22 has a force applied thereto so as to be moved to the left. Since the height of the second paper support unit 22 is formed to be higher than that of the first paper support unit 21, the paper P is moved toward the cutter 41 while being easily folded at the paper input slot 23.

Also, the paper P on the first paper support unit 21 has a small force applied thereto to be moved to the left by the slip prevention part 27 formed on the first paper support unit 21. Later, the paper P is pulled by the cutter 41 and is moved to the right—that is, towards the paper input slot 23.

Here, the firstly fed paper of the first group is asymmetrically folded. First, the paper is moved by the force applied by the roller 30. As the paper is folded into the paper input slot 23, a portion of the paper is fed to the cutter 41. In addition to the force applied by the roller 30, the paper P may be fed into the paper input slot 23 by the force by which the cutter 41 pulls the papers.

Meanwhile, since the length of the first paper support unit 21 is longer than that of the second paper support unit 22, a portion of the paper disposed on the first paper support unit 21 still remains even after a portion of the paper disposed on the second paper support unit 22 is all moved into the paper input slot 23.

Since the roller 30 continuously rotates, while the paper of the first group remains on the first paper support unit 21, the roller 30 applies force to the paper of a second group disposed on the second paper support unit 22. Also, since the secondly fed paper of a second group have force applied thereto together with the paper of the first group as the firstly fed paper of the first group moves, the secondly fed paper of the second group may be smoothly moved to the paper input slot 23 even though force is directly applied only by the roller 30.

Accordingly, since the secondly fed paper of a second group is simultaneously fed into the paper input slot 23 while the firstly fed paper of the first group is fed into the paper input slot 23, it is possible to quickly shred a large quantity of paper.

Figure 8:
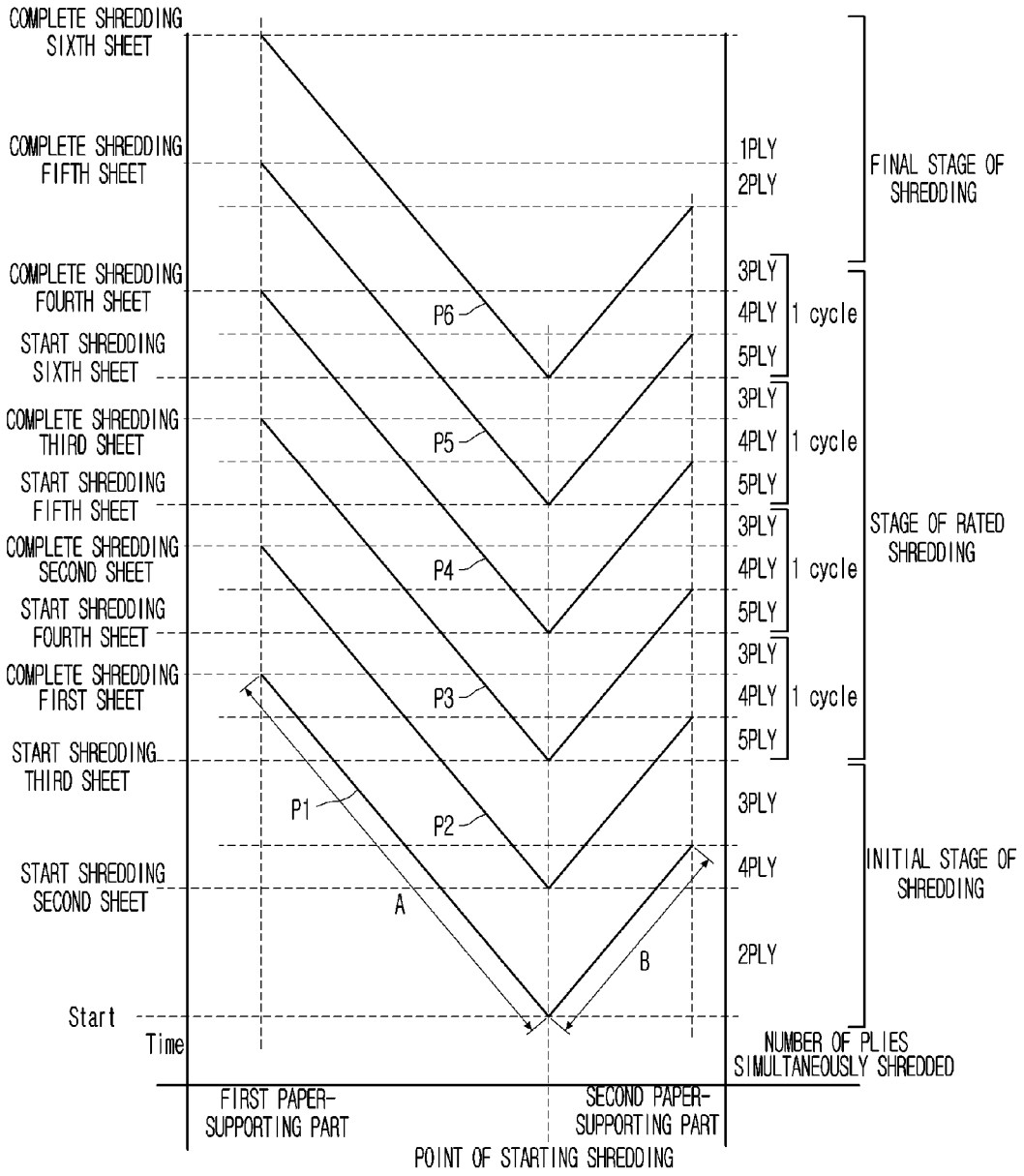
FIG. 8 is a view illustrating a paper shredding method of a paper shredder according to an embodiment.

FIG. 8 is a view illustrating a paper shredding method of a paper shredder according to an embodiment. In describing a method for shredding paper in FIG. 8, for convenience of description, it is exemplarily illustrated that a plurality of sheets of paper are not simultaneously moved by the roller 30, but only one sheet at a time is moved. However, in an actual paper shredder, according to the friction between sheets of paper, about 1 sheet to about 4 sheets of paper may be moved together.

In the current embodiment, the effective length B of the second paper support unit 22 may be formed to be about ⅕ to about ⅓ of the paper length of standard A4 size paper. For example, A4 size paper has a length of about 297 mm, and the effective distance B of the second paper support unit 22 may be formed to be about 59.4 mm to about 99 mm. Of course, the effective distance B of the second paper support unit 22 is not limited to the aforementioned range and may be, for example, smaller than about 59.4 mm, and larger than 99 mm.

Also in the current embodiment, the effective length B of the second paper support unit 22 may be formed to be about ⅕ to about ⅓ of the paper length of standard letter size paper. For example, a letter size sheet of paper has a length of about 279.4 mm, and the effective distance B of the second paper support unit 22 may be formed to be about 55.9 mm to about 93.2 mm. Of course, the effective distance B of the second paper support unit 22 is not limited to the aforementioned range and may be, for example, smaller than about 55.9 mm, and larger than 93.2 mm.

FIG. 8 is a view illustrating paper being shredded while being fed into the paper input slot 23 when the effective distance B of the second paper support unit 22 is set to about 99 mm.

In the paper shredder 300 according to the current embodiment, when a large quantity of paper is disposed at the paper support unit 20, the number of plies of paper which is simultaneously shredded varies with an initial stage of shredding, a rated shredding stage, and a final stage of shredding.

For example, in an initial stage of shredding, while a first sheet of paper P1 is folded, two plies of paper are simultaneously shredded. Next, 4 plies and 3 plies of paper are shredded, and as the shredding enters the rated shredding stage, 5 plies, 4 plies, and 3 plies of paper are shredded to form a constant cycle. When entering the final stage of shredding, 2 plies and 1 ply of paper are shredded.

When the paper shredder 300 is operated with a plurality of sheets of paper disposed on the paper support unit 20, the first sheet of paper P1 disposed on the second paper support unit 22 is asymmetrically folded by the force from the roller 30 and fed into the paper input slot 23 to start shredding. Here, the first sheet of paper P1 is shredded as two plies.

When the shredding of the first sheet of paper P1 is begun by the cutter 41, the first sheet of paper P1 disposed on the first paper support unit 21 is also fed into the paper input slot 23 by the force with which the cutter 41 pulls the paper.

As the first sheet of paper P1 is moved toward the paper input slot 23 on the paper support unit 20, the roller 30 contacts the second sheet of paper P2. Then, the second sheet of paper P2 has the force from the roller 30 applied thereto and is fed into the paper input slot 23 to start being shredded. Here, the first sheet of paper P1 and the second sheet of paper P2, which are disposed in a direction toward the first paper support unit 21 with respect to the center line of the paper input slot 23, and the first sheet of paper P1 and the second sheet of paper P2, which are disposed in a direction toward the second paper support unit 22 with respect to the center line of the paper input slot 23, are simultaneously shredded and 4 plies of paper are shredded.

Since the lengths of the first and second paper support units 21 and 22 are different from each other, the first sheet of paper P1 disposed on the second paper support unit 22 is fed into the paper input slot 23 earlier than the first sheet of paper P1 disposed on the first paper support unit 21 and is shredded.

As the first sheet of paper P1 disposed on the second paper support unit 22 is completely shredded, only the second sheet of paper P2 on the second paper support unit 22 is fed into the paper input slot 23 by means of the torque from the roller 30 and is shredded. Here, the second sheet of paper P2 disposed on the second paper support unit 22 and the first sheet of paper P1 and the second sheet of paper P2 disposed on the first paper support unit 21 are simultaneously shredded and 3 plies of paper are shredded.

Likewise, as the second sheet of paper P2 is moved toward the paper input slot 23 on the paper support unit 20, the roller 30 contacts the third sheet of paper P3. Then, the third sheet of paper P3 has the force from the roller 30 applied thereto and is fed into the paper input slot 23 to start being shredded. Here, the second sheet of paper P2 and the third sheet of paper P3, which are disposed in a direction toward the second paper support unit 22 with respect to the center line of the paper input slot 23, and the first sheet of paper P1, the second sheet of paper P2, and the third sheet of paper P3, which are disposed in a direction toward the first paper support unit 21 with respect to the center line of the paper input slot 23, are simultaneously shredded and 5 plies of paper are shredded.

In this way, the roller 30 sequentially contacts the sheets of paper and feeds the paper into the paper input slot 23. Also, according to a degree of overlap of the paper, about 1 ply to about 5 plies of paper are shredded by the cutter 41. Of course, in the current embodiment, it is assumed that only one sheet of paper is moved when the paper and the roller 30 are in contact with each other. However since about 2 sheets to 3 three sheets of paper may also be simultaneously moved in some cases, the number of plies of paper which are simultaneously shredded by the cutter 41 may vary.

Figure 9:
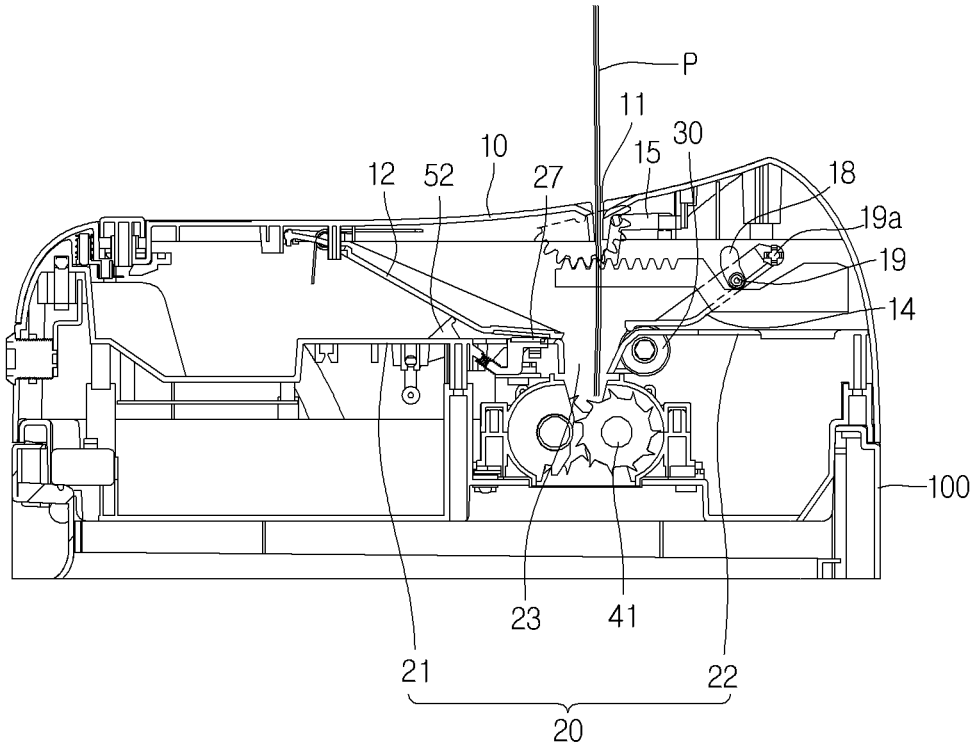
FIG. 9 is a view illustrating manual shredding of paper in a paper shredder according to an embodiment.

FIG. 9 is a view illustrating manual shredding of paper in a paper shredder according to an embodiment.

The cover 10 has the manual paper input slot 11 which is formed over the paper input slot 23 and through the cover 10. The manual paper input slot 11 is disposed between the first press unit 12 and the second press unit 14.

A paper detection sensor 15 is disposed at the manual paper input slot 11 to control the operation of the cutter 41 according to whether paper is fed or not.

Accordingly, when paper is fed into the manual paper input slot 11, the paper passes through the paper input slot 23 and is shredded by the cutter 41. Here, the paper detection sensor 15 detects the paper, and accordingly, the control unit controls the cutter 41 to operate.

Although the present invention has been described through the embodiments and the accompanying drawings, the scope of the present invention is not limited therein, and those skilled in the art will appreciate that simple modifications are possible, without departing from the scope and spirit of the invention as disclosed in the accompanying claims. For example, each component shown in detail in the exemplary embodiments may be modified and implemented. In addition, it should be understood that difference associated with the modification and application are included in the scope of the present invention defined in the appended claims.

INDUSTRIAL APPLICABILITY

A paper shredder according to embodiments may reduce failures which occur in an automatic paper supply system, such as paper jams, excessive paper feeds, paper feed failures, and may more quickly shred paper.

What is claimed is:

1. A paper shredder comprising:

a paper support unit comprising a first paper support unit having a first length, a second paper support unit parallel with the first paper support unit and having a second length shorter than the first length, and a paper input slot between the first paper support unit and the second paper support unit;

a roller having a portion that is exposed to an upper side of the second paper support unit through an opening formed in the second paper support unit;

a cutter disposed under the paper input slot and shredding inserted paper; and a cover disposed on the paper support unit, wherein the second paper support unit is formed to be higher than the first paper support unit.

2. The paper shredder of claim 1, wherein the second paper support unit is positioned about 3 mm to about 10 mm higher than the first paper support unit.

3. The paper shredder of claim 1, wherein the paper support unit comprises a paper stack detection sensor detecting whether paper is stacked.

4. The paper shredder of claim 1, wherein the cover comprises a press unit pressing paper disposed between the cover and the paper support unit.

5. The paper shredder of claim 4, wherein the press unit comprises:

a first press unit disposed at a top of the first paper support unit; and a second press unit disposed at a top of the second paper support unit.

6. The paper shredder of claim 5, wherein the second press unit is spaced apart from the second paper support unit when the cover is opened, and contacts the second paper support unit when the cover is closed.

7. A paper shredder comprising:

a paper support unit comprising:

a first paper support unit having a first length;

a second paper support unit parallel with the first paper support unit and having a second length shorter than the first length; and a paper input slot between the first paper support unit and the second paper support unit;

a roller having a portion that is exposed to an upper side of the second paper support unit through an opening formed in the second paper support unit;

a cutter disposed under the paper input slot and shredding inserted paper; and a cover disposed on the paper support unit, wherein the cover comprises a press unit pressing paper disposed between the cover and the paper support unit, wherein the press unit comprises:

a first press unit disposed at a top of the first paper support unit; and a second press unit disposed at a top of the second paper support unit, wherein the second press unit is spaced apart from the second paper support unit when the cover is opened, and contacts the second paper support unit when the cover is closed, wherein the paper shredder further comprising:

a rotating gear coupled to the cover and rotating as the cover is opened and closed;

a horizontally moving gear engaging with the rotating gear and horizontally moving according to rotation of the rotating gear; and a position adjusting member coupled to the second press unit, and moving along an inclined surface formed on the horizontal moving gear according to movement of the horizontally moving gear.

8. A paper shredder comprising:

a paper support unit comprising:

a first paper support unit having a first length;

a second paper support unit parallel with the first paper support unit and having a second length shorter than the first length; and a paper input slot between the first paper support unit and the second paper support unit;

a roller having a portion that is exposed to an upper side of the second paper support unit through an opening formed in the second paper support unit;

a cutter disposed under the paper input slot and shredding inserted paper; and a cover disposed on the paper support unit, wherein the first paper support unit comprises a slip prevention part preventing slipping of paper.

9. The paper shredder of claim 8, wherein the slip prevention part is formed of a rubber material.

10. The paper shredder of claim 1, wherein the cover comprises a manual paper input slot disposed at a top of the paper input slot.

11. The paper shredder of claim 10, wherein the manual paper input slot comprises a paper detection sensor for detecting fed paper.

12. The paper shredder of claim 1, wherein the second paper support unit is formed in a length of about ⅕ to about ⅓ of the length of letter size paper.

13. The paper shredder of claim 1, wherein the roller is formed of a rubber material or has a fin formed thereon.

* * * * *